United States Patent [19]

Schasteen et al.

[11] Patent Number: 4,883,120

[45] Date of Patent: Nov. 28, 1989

[54] LATCHING TOOL FOR RETRIEVING WELLBORE DEVICES

[75] Inventors: Thomas Schasteen, Garland; Lonnie J. Smith, Allen, both of Tex.

[73] Assignee: Atlantic Richfield Company, Los Angeles, Calif.

[21] Appl. No.: 298,391

[22] Filed: Jan. 18, 1989

[51] Int. Cl.[4] ..... E21B 31/18

[52] U.S. Cl. ..... 166/98; 294/86.33

[58] Field of Search ..... 166/98, 301; 294/86.26, 294/86.27, 86.29, 86.33

[56] References Cited

U.S. PATENT DOCUMENTS 2,410,262 10/1946 Breaux ..... 294/86.33 X 4,382,623 5/1983 Richardson ..... 294/86.33 X

*Primary Examiner*—William P. Neuder

*Attorney, Agent, or Firm*—Michael E. Martin

[57] ABSTRACT

A latching tool for retrieving downhole well instruments and devices is adapted to be connected to the lower end of a tubing string for movement for movement to engage a fishing head connected to the instrument or device to be retrieved from the wellbore. The latching tool includes a body made up of separable members and having a through bore formed therein, plural radially movable spring biased latching dogs, and an elongated sleeve disposed for sliding movement in said bore for holding said latching dogs in a retracted position and permitting said latching dogs to move to an extended and latching position in response to movement of the sleeve.

6 Claims, 1 Drawing Sheet

LATCHING TOOL FOR RETRIEVING WELLBORE DEVICES

BACKGROUND OF THE INVENTION

1. Field of the Invention

The present invention pertains to a tool for connection to the lower end of a tubing string for latching onto and retrieving wellbore devices such as downhole pressure and temperature instrument units.

2. Background

In certain well operations it is desirable to retrieve instruments or other devices from the wellbore without making a special trip into and out of the wellbore with a retrieving tubing string or other equipment. In this regard, it has been considered desirable to provide a latching or retrieving tool which is connected to the tubing string which is used in stimulation or workover operations or related wellbore processes.

SUMMARY OF THE INVENTION

The present invention provides a latching tool for connection to a tubing string or the like and adapted to retrieve certain downhole tools, instruments and other devices.

In accordance with one aspect of the present invention, a retrieving or latching tool is provided which may be connected to the lower end of a tubing string, which tubing string is used for certain well operations including workover, fluid injection and fracturing operations or the like. The latching tool is provided with a unique arrangement of spring loaded catches or latch members which are deployed for engagement with a transverse shoulder formed on a fishing head or the like, which fishing head is insertable in a bore formed by the latching tool housing. The spring loaded latches are preferably retained in a retracted position and shielded from the flow of abrasive or corrosive fluids by a retractable sleeve which is activated by the fishing head as the head is inserted into the bore of the latching tool.

By providing a latching tool according to the invention as the lowermost member of a tubing or "workstring" which is deployed in a wellbore for conducting fluids to and from a region of interest, certain downhole devices such as pressure and temperature measuring instrument units may be retrieved without making special trips into and out of the well with a separate tubing string. By providing the latching tool on the lower end of the so-called workstring, devices left in the wellbore may be easily retrieved without making a separate trip into the wellbore with specialized retrieving equipment.

The above-described advantages and superior features of the present invention together with other important aspects thereof will be further appreciated by those skilled in the art upon reading the detailed description which follows in conjunction with the drawing.

DESCRIPTION OF A PREFERRED EMBODIMENT

Figure 1:
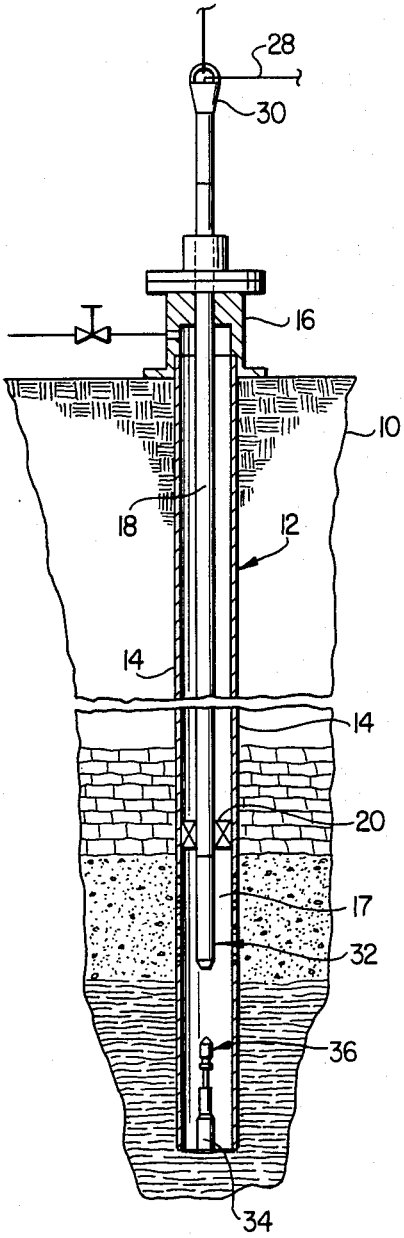
FIG. 1 is a vertical section view in somewhat schematic form of a well in which a tubing string including the latching tool of the present invention is disposed.

In the description which follows, like parts are marked throughout the specification and drawing with the same reference numerals, respectively. The drawing figures are not necessarily to scale and certain elements may be shown in schematic form in the interest of clarity and conciseness.

Referring to FIG. 1, there is shown an earth formation 10 into which a wellbore 12 has been drilled and is provided with a casing 14 and a conventional wellhead 16. In certain operations, such as in hydraulic fracturing of the subterranean formation, an elongated tubing string or so-called workstring 18 is extended into the wellbore through suitable mechanism in the wellhead for pumping fluids into the wellbore cavity 17 for stimulating or fracturing the formation region of interest. The tubing string 18, typically, may include a retrievable packer 20 associated therewith for isolating the cavity 17 from the remainder of the wellbore. The tubing string 18 extends through the wellhead 16 and may include suitable means for raising and lowering the tubing string within the wellbore including a drilling rig, not shown. A conduit 28 is connected to the upper end of the tubing string through conventional swivel means 30 which is connected to suitable drawworks, not shown, which conduit is operable for injecting fluids down through the tubing string into the cavity 17.

The lower end of the tubing string 18 is provided with a unique latching tool 32 comprising the distal end of the tubing string. The latching tool 32 is adapted to latch onto and retrieve a wellbore instrument unit 34 having a retrieving or fishing head member 36 connected thereto and positioned to be engaged by the latching tool for retrieving the instrument unit from the wellbore. By providing the latching tool 32 as an integral distal end part of the tubing string 18, upon completion of measurements or other operations involving the instrument unit 34, the tubing string may be lowered to cause the latching tool 32 to engage the retrieving head 36 whereby the instrument 34 may be pulled up through the wellbore and the wellhead 16 for retrieval.

Figure 2:
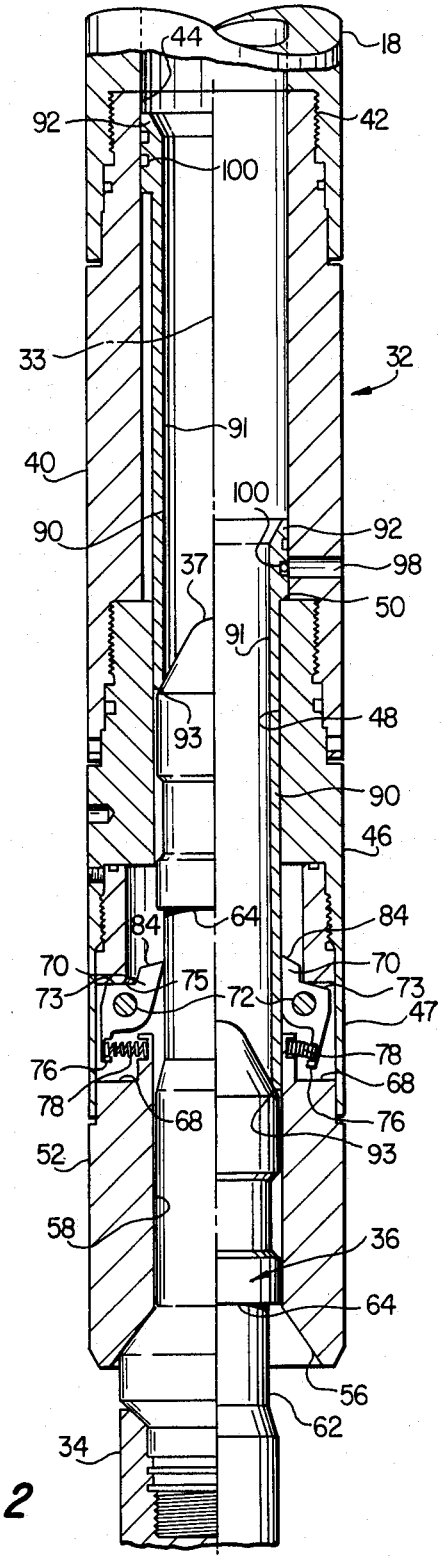
FIG. 2 is a longitudinal split section view showing the latching tool in a latching and nonlatching position, respectively.

Referring now to FIG. 2, the retrieving or latching tool 32 is shown in longitudinal central section with the operating mechanism in two positions by way of a split section view. To the left of the longitudinal central axis 33, viewing FIG. 2, the tool 32 is shown in the position wherein the retrieving head 36 has entered the tool and is in a position to be secured to the tool for retrieval of the instrument from the wellbore. Viewing the right half of the longitudinal central section view, the head 36 is shown just entering the tool before actuation of the tool mechanism to be described herein.

The tool 32 includes an elongated cylindrical upper body member 40 having suitable thread means 42 at its upper end for threadedly connecting the tool to the tubing string 18. The body member 40 includes a central bore 44 forming a fluid passage in communication with the interior of the tubing string 18. The body member 40 is threadedly connected to an intermediate body member 46 which is also of generally cylindrical configuration and has a slightly reduced diameter bore 48, with respect to the bore 44, and forming a transverse shoulder 50 at the point of intersection with the bore 44. The intermediate body member 46 is threadedly connected to the body member 40 and to a lower body or guide member 52. The guide member 52 includes a conical opening formed in the lower transverse end thereof defined by a guide surface 56 for guiding the upper distal end 37 of the retrieving head 36 into a bore 58 formed in the guide member. The retrieving or fishing head 36 includes at least one reduced diameter cylindrical body portion 62 forming a transverse shoulder 64 for engagement with one or more latching dogs disposed on the lower body or guide member 52.

As shown in FIG. 2, the guide member 52 includes suitable opposed recesses 68 in which are disposed, respectively, pivotally supported latching dogs 70. A sleeve portion 47 of the body member 46 covers one side of the recesses 68. The latching dogs 70 are each supported on the body member 52 by suitable pivot pins 72 and the dogs include respective arm portions 76 which are engageable with coil springs 78 for biasing the dogs to pivot into the space defined by the bore 58. A shoulder 73 is engageable with a surface 75 on the body member 52 to limit the pivotal movement of the dog 70 under the urging of the spring 78. Each of the dogs 70 includes a pointed distal end portion 84 operable to engage the transverse surface or shoulder 64, for example, to latch the retrieving head 36 to the tool 32 for retrieval of the instrument unit 34 or other device which might be attached to the head 36 in other applications thereof. The number of latching dogs 70 may be as few as one, total, although three dogs, equally spaced apart circumferentially around the guide member 52, is a preferable number for redundancy and minimal loading on the respective dog members. Two opposed dogs 70 are shown in FIG. 2 for the sake of brevity.

As further illustrated in FIG. 2, an elongated tubular sleeve 90 is disposed in the bore 48 and extends, in the position shown on the right hand side of FIG. 2, toward the bore 58 and covering the recesses 68. The sleeve 90 includes an elongated central bore 91 forming a passage through the sleeve for conducting fluids between the tubing string 18 and the cavity 17. The sleeve 90 also includes a lower end 93 and a head portion 92 which is slidably disposed in the bore 44 in close fitting relationship thereto. The sleeve 90 is releasably held in the position shown on the right hand side of FIG. 2 by a spring biased ball detent mechanism 98 of conventional construction. A suitable groove or recess 100 is formed in the head portion 92 for registration with the ball detent mechanism 98 to prevent unwanted movement of the sleeve 90 upward in the bore 44. The sleeve 90 is normally disposed in the position in which the head 92 is engaged with the shoulder 50 and is retained in such position by the detent mechanism 98. This position of the sleeve covers the recesses 68 to prevent unwanted flow of debris laden fluid into the recesses to interfere with operation of the latching dogs 70 and to hold the latching dogs in a retracted position.

When the tool 32 is to be used to engage the retrieving or fishing head 36, the tubing string 18 is lowered until the guide surface 56 engages the distal end 37 of the head to guide the head into the bore 58 and for engagement with the lower end 93 of the sleeve 90. As the tubing string 18 and tool 32 are further lowered over the head 36, the sleeve 90 is moved upward to allow the latching dogs 70 to pivot about their axes formed by the pivot pins 72 into engagement with the head 36. Once the shoulder 64 has passed the dogs 70 the bias imposed on the dogs by the springs 78 will urge the pointed ends 84 into registration with the transverse shoulder 64 as the head 36 attempts to leave the bore 58 and become unlatched from the tool.

With the dogs 70 biased into engagement with the head 36 the head 36 and any device attached thereto may be retrieved with the tubing string 18 without first removing the tubing string and inserting a separate means for latching to the head 36. When the tool 32 and the head 36 have been retrieved from the wellbore, the guide member 52 may be threadedly uncoupled from the intermediate body member 46 and the latching dogs 70 pivotally moved out of engagement with the shoulder 64 so that the head 36 can be separated from the latching tool.

Thanks to the provision of the tool 32 as a substantially integral distal end member of the tubing string 18, the retrieval of certain wellbore instruments or other devices may be easily accomplished without the necessity of inserting separate fishing or retrieving devices into the wellbore through the tubing string 18 or replacing the tubing string 18 with a special retrieval tubing string. The tool 32 may be manufactured of conventional engineering materials used in wellbore devices and the head 36, which may be easily connected to and disconnected from a wellbore device, may also be made from conventional engineering materials.

Although a preferred embodiment of the present invention has been described in detail herein, those skilled in the art will recognize that various substitutions and modifications may be made to the invention without departing from the scope and spirit thereof as recited in the appended claims.

What is claimed is:

1. A latching tool for latching onto a head member connected to a wellbore device and wherein said head member includes a means forming a transverse surface thereon, said latching tool comprising:

elongated body means including means for connecting said latching tool to a tubing string insertable in said wellbore for disposition of said latching tool at the lower end of said tubing string;

a guide surface on said body means for engaging said head member for movement of said head member into a bore formed by said body means;

at least one pivotally mounted latching dog disposed on said body means and movable between a retracted position out of engagement with said head member to a position for engagement with said head member for retrieval of said device from said wellbore; and means for holding said at least one latching dog in a retracted position, said means for holding being engageable by said head member for movement with said head member to release said latching dog for engagement with said head member.

2. The tool set forth in claim 1 wherein:

said means for holding includes passage means formed therein for conducting fluid through said latching tool from said tubing string.

3. The apparatus set forth in claim 2 wherein:

said means for holding comprises an elongated sleeve disposed in a bore formed in said body means.

4. The apparatus set forth in claim 2 including:

means for releasably retaining said means for holding in a position to hold said latching dog retracted from engagement with said head member.

5. The apparatus set forth in claim 1 wherein:

said body means includes first and second body members which are releasably coupled one to the other, one of said body members including a sleeve portion overlying said latching dog and said latching dog is mounted on the other of said body members, and said body members may be released from engagement one with the other to provide access to said latching dog to move said latching dog to a nonlatching position with respect to said head member.

6. A latching tool for latching onto a head member connected to a wellbore device and wherein said head member includes a means forming a transverse surface thereon, said latching tool comprising:

elongated body means including a bore formed therein for conducting fluid and means for connecting said latching tool to a tubing string insertable in said wellbore for disposition of said latching tool at the lower end of said tubing string;

a guide surface on said body means for engaging said head member for movement of said head member into a bore formed by said body means;

latching means disposed on said body means and movable between a retracted position out of engagement with said head member to position for engagement with said head member for retrieval of said device from said wellbore;

an elongated sleeve disposed in said bore for holding said latching means in said retracted position, said sleeve including passage means formed therein for conducting fluid through said latching tool from said tubing string, said sleeve being engageable by said head member for movement with said head member to release said latching means for engagement with said head member, and means for releasably retaining said sleeve in a position to hold said latching means retracted from engagement with said head member.

* * * * *